US006386439B2

(12) United States Patent
Le Bras

(10) Patent No.: US 6,386,439 B2
(45) Date of Patent: May 14, 2002

(54) TRAY CONTAINER AND BLANK

(75) Inventor: Philippe Le Bras, Chateauroux (FR)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 09/835,423

(22) Filed: Apr. 16, 2001

Related U.S. Application Data

(63) Continuation of application No. PCT/US99/23844, filed on Oct. 14, 1999.

(30) Foreign Application Priority Data

Oct. 14, 1998 (GB) ..... 9822461

(51) Int. Cl.[7] ..... B65D 5/22; B65D 5/42

(52) U.S. Cl. ..... 229/119; 206/204; 229/171; 229/406; 229/407

(58) Field of Search ..... 229/119, 171, 229/406, 407; 206/204; 220/62.18, 62.19, 62.2; 426/124, 129

(56) References Cited

U.S. PATENT DOCUMENTS

| | | | | | |
|---|---|---|---|---|---|
| 3,026,209 | A | * | 3/1962 | Niblack et al. | 206/204 |
| 3,040,949 | A | * | 6/1962 | Foote | 229/407 |
| 3,515,331 | A | * | 6/1970 | Guthrie, Sr. | 206/204 |
| 3,575,287 | A | * | 4/1971 | Graveley | 229/407 |
| 3,640,209 | A | * | 2/1972 | Wilson | 426/124 |
| 4,003,184 | A | | 1/1977 | Shiu | 53/461 |
| 4,253,602 | A | * | 3/1981 | Kulig | 229/171 |
| 4,702,377 | A | * | 10/1987 | Grone | 229/407 |
| 4,860,887 | A | | 8/1989 | Fosse | 206/204 |
| 4,877,932 | A | | 10/1989 | Bernstein et al. | 219/730 |
| 4,949,897 | A | * | 8/1990 | Pawlak et al. | 229/407 |
| 5,385,292 | A | | 1/1995 | Labianca et al. | 229/120 |
| 5,816,488 | A | * | 10/1998 | Moeder | 229/406 |
| 6,079,555 | A | * | 6/2000 | Posson | 426/129 |
| 6,216,855 | B1 | * | 4/2001 | Grone | 426/124 |

FOREIGN PATENT DOCUMENTS

| | | |
|---|---|---|
| EP | 0 495 230 A2 | 7/1992 |
| FR | 2 614 877 | 11/1988 |
| GB | 924689 | 5/1963 |
| GB | 1089612 | 11/1967 |
| WO | WO 93/09032 | 5/1993 |
| WO | WO 94/04435 | 3/1994 |
| WO | WO 95/35204 | 12/1995 |

* cited by examiner

*Primary Examiner*—Gary E. Elkins
(74) *Attorney, Agent, or Firm*—Thomas A. Boshinski

(57) ABSTRACT

A tray and a blank for forming the tray for holding foodstuff or the like are disclosed. The tray is formed from paperboard or similar foldable sheet material, and includes a base and opposed side and end walls hingedly connected to the base. Means are provided to give fluid communication between the surface of the base that forms the tray interior and a void so that fluid present in the tray can drain into the void. The void is formed by a double skinned zone adjacent at least a portion of the intersection between the base and at least one of the side and/or end walls, the double skinned zone being provided by folded outer panels of the opposed side and/or end walls.

12 Claims, 4 Drawing Sheets

TRAY CONTAINER AND BLANK

CROSS-REFERENCE TO RELATED APPLICATIONS

This is a continuation of international application No. PCT/US99/23844, filed Oct. 14, 1999, which is pending at the time of filing hereof.

BACKGROUND OF THE INVENTION

The present invention relates to a carton (or tray) for accommodating foodstuff, for example fish or meat, and more particularly to a carton formed from one or more blanks of paperboard of other suitable foldable sheet material.

Tray structures for meat are commonly formed from plastics material, for example polystyrene.

There can be excess food liquid, for example blood or water from foodstuff, which is undesirable. One solution is illustrated in U.S. Pat. No. 3,156,402 which shows a food products support tray including two layers in which the liquid is stored. The liquid passes through openings and is held between the layers. It is apparent that handling of the tray will push liquid back through the openings. Further, if the tray is stored in an upright position, the liquid will collect along the edges and at the corners.

BRIEF SUMMARY OF THE INVENTION

The present invention and its preferred embodiments seek to overcome or at least mitigate the problems of the prior art.

One aspect of the invention provides a tray for holding foodstuff or the like which tray may be formed from paperboard or similar foldable sheet material, the tray including the base wherein the base has a doubled skinned zone providing a void wherein means are provided to give fluid communication between the internal surface of the base and said void so that fluid present in the tray can drain into the void.

According to an optional feature of this aspect of the invention the double skinned zone may extend to an adjacent sidewall and, optionally, a void may be provided in the adjacent sidewall.

According to another optional feature of this aspect of the invention the fluid communication means may comprise a plurality of perforations. Preferably, the plurality of perforations are distributed along at least one edge of the base. According to another optional feature of this aspect of the invention the void may include absorbing means placed between the inner and outer base panels to absorb said liquid. Preferably, the absorbing means is provided by the surfaces of double skinned zone. Optionally, the absorbing means comprises a layer of liquid absorbing material placed in the void.

According to a further optional feature of this aspect of the invention the internal surface of the base may be impermeable. Preferably, the internal surface may be coated with an impermeable layer. In these embodiments the impermeable layer may be a co-polymer, for example carboxylated styrene or butadiene.

A second aspect of the invention provides a blank for forming a tray for holding foodstuff or the like comprising a base panel, side and end panels hingably connected to the base panel and further including a securing means for securing together adjacent side and end panels to form a corner of the tray, wherein the base panel has a double skinned zone providing a void wherein means are provided to give fluid communication between the internal surface of the base and said void so that fluid present in the erected tray can drain into the void.

According to an optional feature of the second aspect of the invention, the double skinned zone may extend to said side and end panels to provide an extension of the void.

According to another optional feature of the second aspect of the invention, said fluid communication means may comprise a plurality of perforations distributed along at least one edge of said base panel.

BRIEF DESCRIPTION OF THE SEVERAL VIEWS OF THE DRAWINGS

An embodiment of the invention will now be described, by way of example only, with reference to the accompanying drawings in which.

DETAILED DESCRIPTION OF THE PREFERRED EMBODIMENTS

Figure 1:
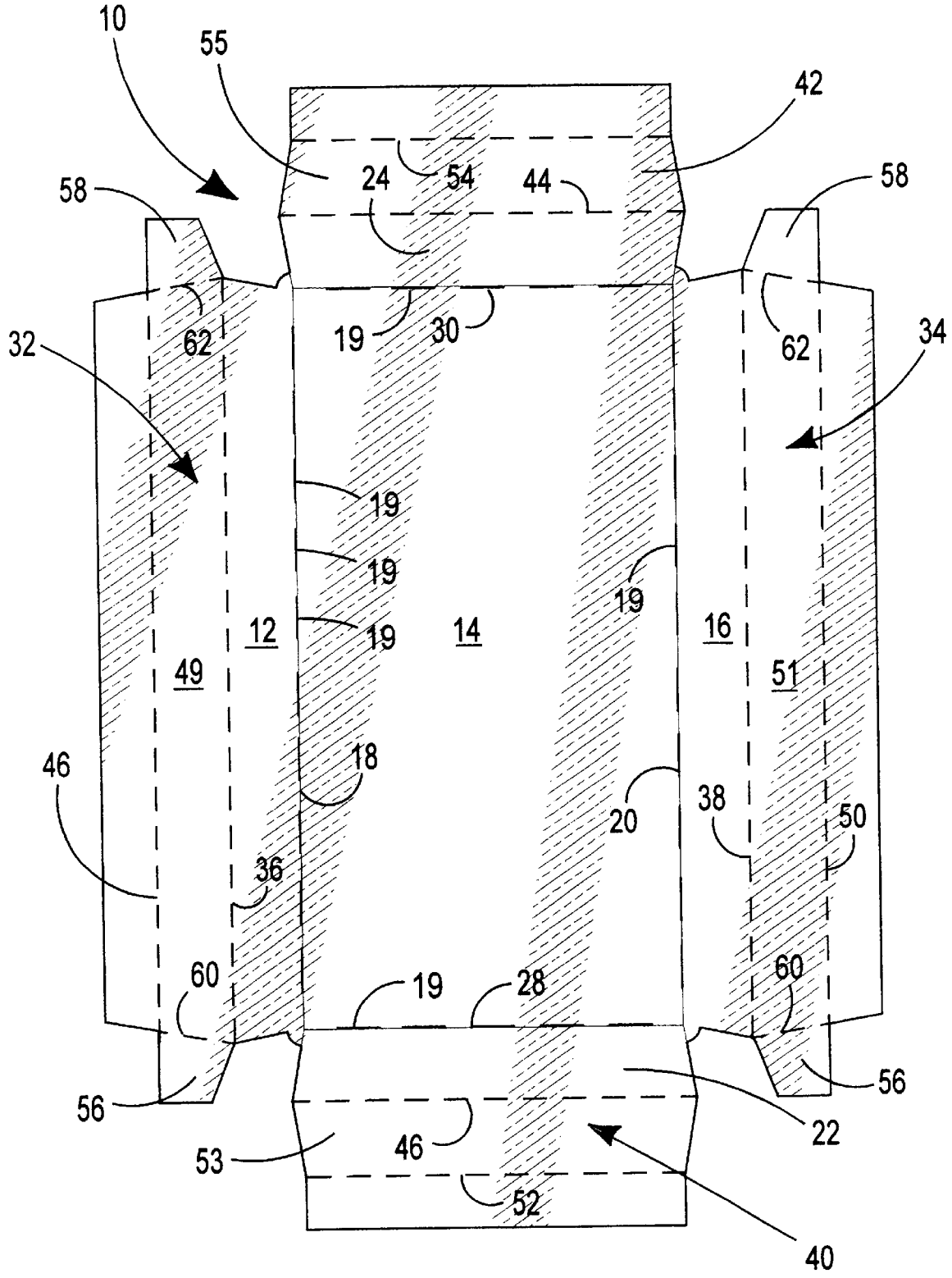
FIG. 1 is a plan view of a blank for forming a carton according to a preferred embodiment of the invention.

Referring first to FIG. 1 there is shown a blank 10 for forming a collapsible tray or carton made from one or more blanks of paperboard or similar foldably sheet material. The blank 10 comprises first side panel 12, base panel 14, and second side panel 16 hingably connected together in series along foldlines 18, 20 respectively. There further comprises opposed end panels 22, 24 hingably connected to opposite lateral edges of outer base panel 14 along fold lines 28, 30 respectively.

When the tray is in a set up condition, base panel 14 includes a double skinned zone, which in this embodiment, is formed by one or more panels. Preferably, the double skinned zone extends into the or each side and end walls 12, 16, 22, 24. In this embodiment, the double skinned zone is provided by side support panels 32, 34 foldably connected to side panels 12 and 16 by fold lines 36, 38 respectively. There may further comprise end support panels 40, 42 foldably connected to end panels 22, 24 along fold lines 44, 46. Optionally, side support panels 32, 34 include fold lines 46, 50 respectively spaced from and parallel to fold lines 18, 20 respectively to define portions 49 and 51. Each portion 49 and 51 substantially correspond to the height and/or shape of side panels 12, 16 respectively. Likewise, end support panels 40, 42 may include fold lines 52, 54 respectively spaced from and parallel to fold lines 36, 38 to define portions 53, 55 substantially corresponding to the height and/or shape of end panels 22, 24.

Suitable securing means for connecting the end and side panels together is provided. In this embodiment, there comprises a pair of oppositely disposed securing flaps 56, 58 extending from opposite ends of side support panels 32 and 34 and connected thereto along fold lines 60 and 62 respectively.

As illustrated in FIG. 1, fold lines 18, 20 and 28, 30 are preferably defined in part by a series of interrupted cuts 19 for ease of folding the adjacent panels. The cuts may be shaped and configured to help with removal of excess food liquid.

Figure 2:
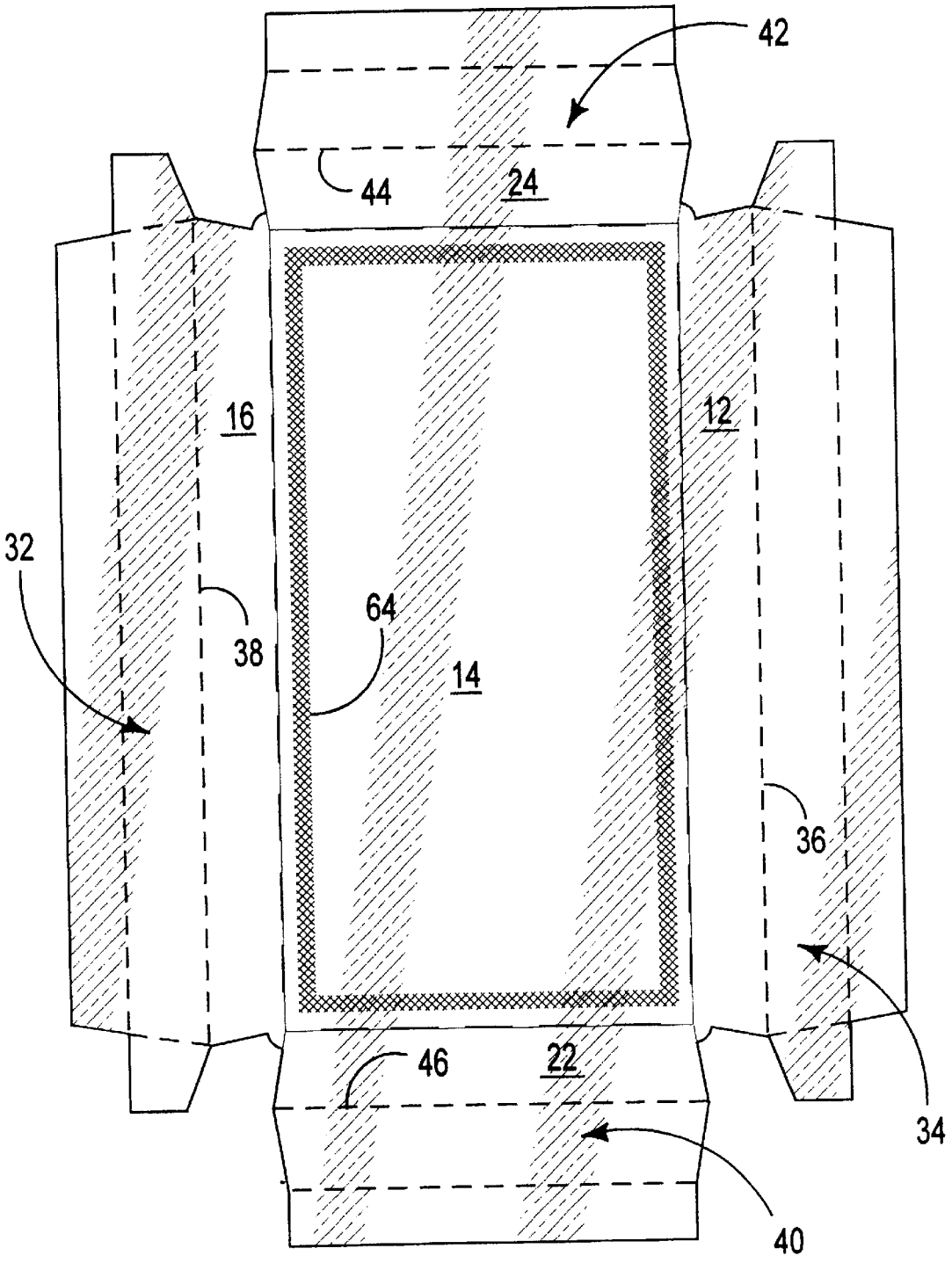
FIG. 2 is an underside plan view of the blank shown in FIG. 1.
Figure 3:
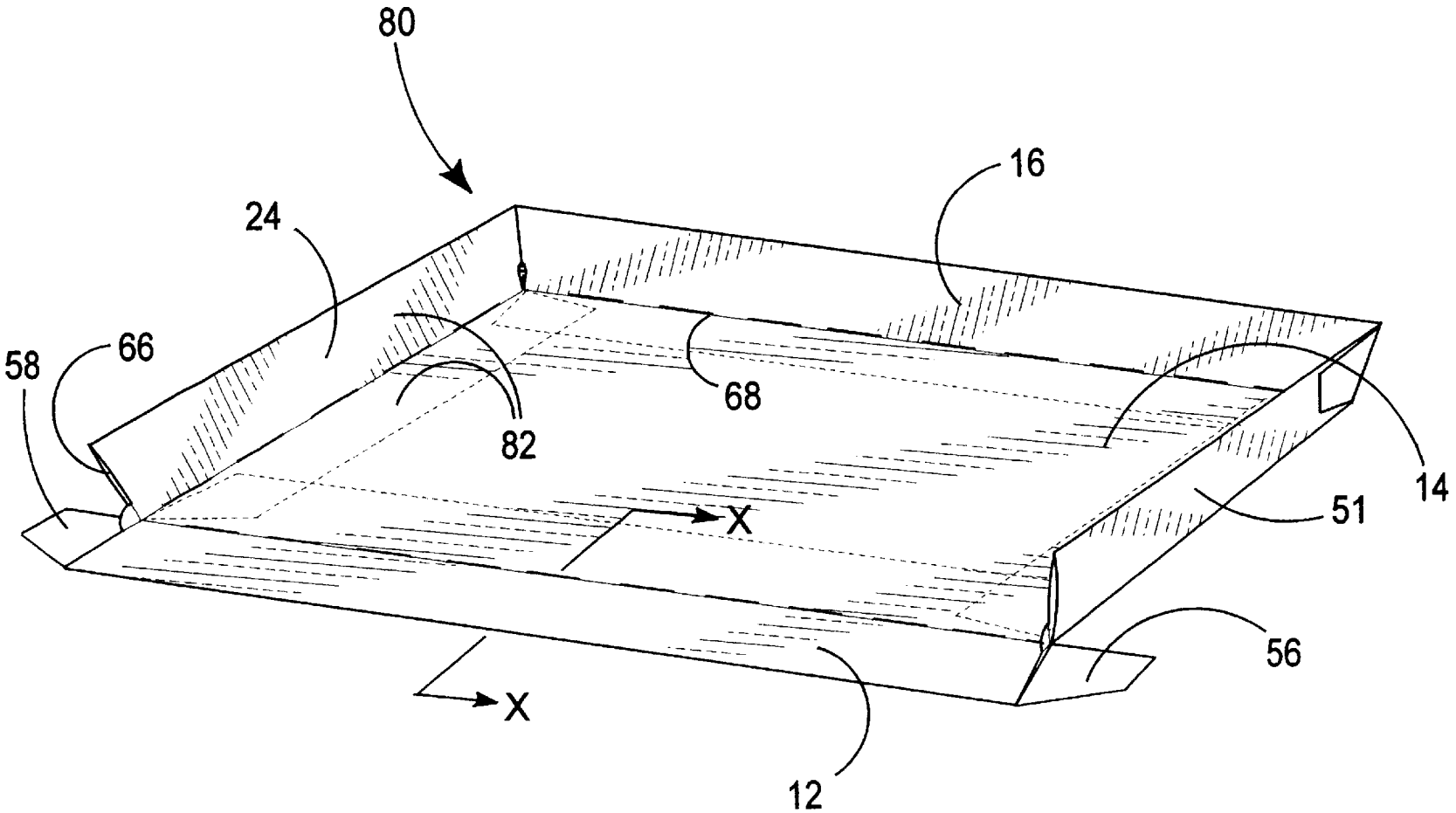
FIG. 3 illustrates an isometric view of the carton formed from the blank illustrated in FIG. 1 shown during folding.

Turning to the construction of the tray illustrated in FIGS. 2 and 3, side support panels 32 and 34 are folded about fold line 36 and 38 respectively and into face contacting relationship with side panels 12 and 16 respectively, and is secured to the base panel 14 by glue or other suitable securing means 64. Likewise, end support panels 42 and 44 are folded about fold lines 44 and 46 and into face contacting relationship with the lower surface of end panels 22, 24 and the outer portions of the side and end panels are secured to base panel by glue or other suitable securing means 64. FIG. 2 illustrates one example of the position of glue applied to the underside of the blank prior to folding the carton. Preferably, the glue is in the form of "hot melt" so to provide a seal between the base and the respective support walls to prevent migration of the liquid, described in more detail below. Thus, the carton is in a flat collapsed form to be supplied to the user so that it can be erected to provide a tray.

It is envisaged that the carton of the present invention can be formed by a series of sequential folding and gluing operations which can be formed in a straight line machine so that the carton is not required to be rotated or inverted to complete its construction. The folding process is not limited to that described below and can be altered according to the particular manufacturing requirements.

The carton (or tray) is formed by folding side panels 12, 16 inwardly about fold lines 18, 20 respectively to define the sidewalls, as shown in FIG. 3. The end walls are formed by folding the end panels 22, 24 about fold lines 28, 30. Finally, the securing flaps 56, 58 are secured to the end panels 22, 24 by glue or other suitable means to retain the tray in a set up condition and to seal the ends of the double skinned zones 82, as illustrated in FIG. 3. Thereafter, foodstuff is loaded into the tray from above and stretch film can be applied to the tray to seal the package.

Figure 4:
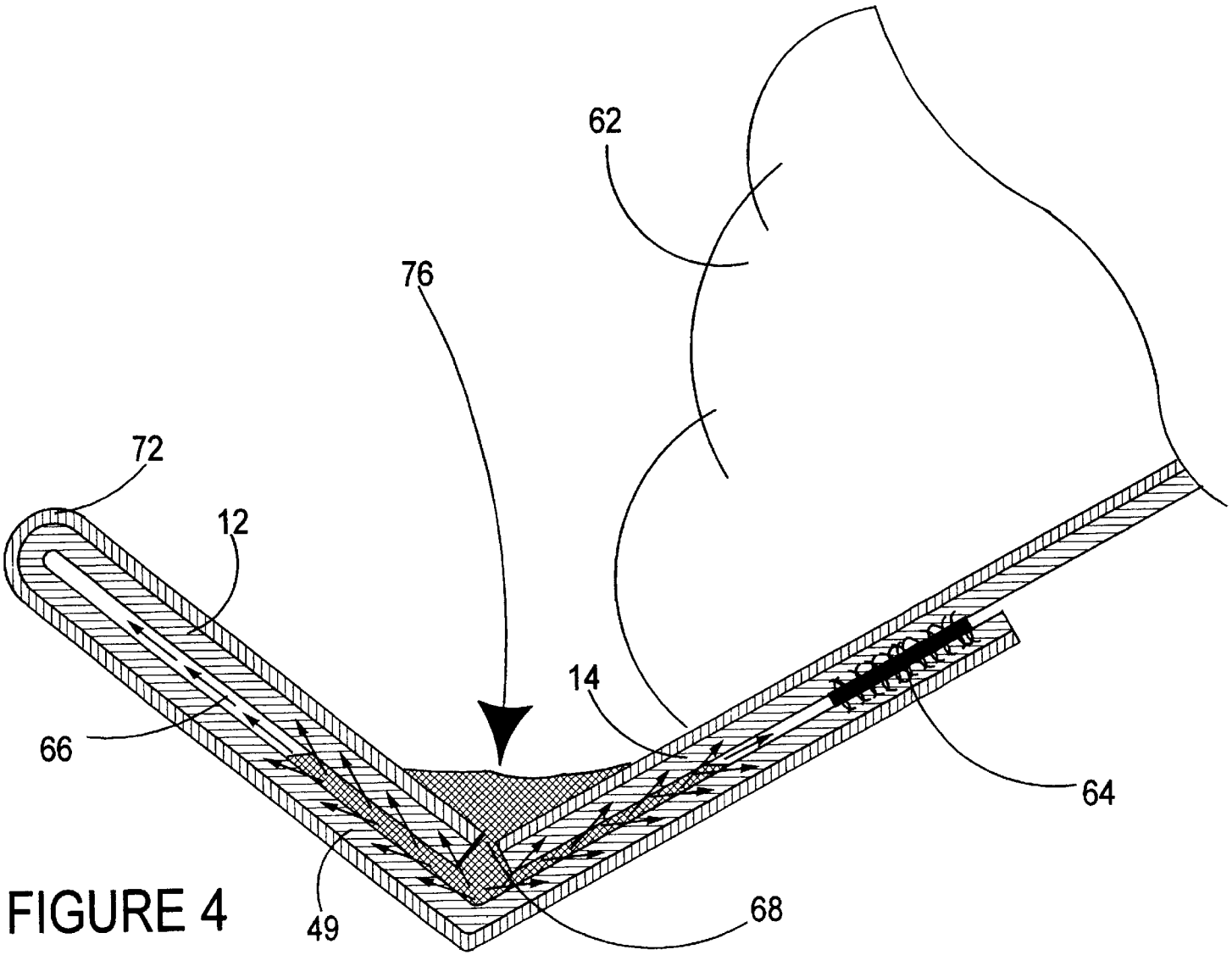
FIG. 4 is a cross-sectional view X—X of the carton formed from a blank shown in FIG. 3.

Thus, a tray 80 for holding foodstuff or the like which tray is formed from paperboard or like foldable sheet material and can be erected from a flat collapsed condition into a position of use and includes a double skinned zone 82 around the side and end walls 12, 16, 22, 24 and part of base panel 14 to provide a void 66, shown in FIGS. 3 and 4.

In use, excess liquid (or exudate) 76 from the foodstuff 62 is retained in the tray because the base is impermeable. Preferably, the panels providing an internal surface, for example the base 14, side and end walls 12, 16, 22, 24 are coated with an impermeable layer 72. In the embodiment described above the impermeable layer 72 is a co-polymer for example carboxylated styrene or butadiene. As shown in FIG. 4, the cross section of the support panels of this embodiment would comprise in series from the inner surface: co polymer, printed matter (if desired), white coating, and board.

When the tray is stacked in an upright position, for example on a supermarket shelf, excess liquid tends to collect at the edges and in the corners. In order to remove excess fluid from the tray, a void 66 is provided by the double skinned zone 82, shown in more detail in FIG. 4. The resulting void 66 is between the side (and end) panels 12, 16 and the support panels 32, 34 and 40, 42 which can be used to receive surplus food liquid (e.g. blood or water) present in the tray by means to give fluid communication between the internal surface of the base and the void.

It is envisaged that the or each void 66 could be adapted to receive suitable absorbing material, for example absorbing stamp or bag, preferably during the initial set up process or by the application of absorbing polymer gel, for example polyacrylamide, during the set up or gluing steps of carton construction. More preferably, liquid can be absorbed directly by the inner surfaces 49 of the panels providing the double skinned zone as shown in FIG. 4. In one class of embodiments the effect of capillarity encourages movement of the liquid away from fluid communication means in the void. The use of hot melt glue 64 at the free end of the support panels stops the migration of the liquid.

Preferably, the means 68 to give fluid communication is provided by a plurality of cuts or perforations 19 struck from the inner base panel 22 to assist in movement of liquid from the upper surface of the inner base panel 22 into the or each void 66. In those embodiments where fold lines 18, 20, 28, 30 are defined in part by a series of cuts 19, the cuts can assist in fluid movement.

Beneficially, the two ply embodiment hereinbefore described provides a structure that is strengthened to retain foodstuff. The use of paperboard material provides an "environmentally friendly" alternative to trays formed from plastics material and the tray can include printed matter for marketing purposes. The arrangement of the panels for the tray in the embodiment described above allows printed matter to be placed on the internal and external side and end walls of the tray.

It will be recognised that as used herein, directional references such as "top", "base", "end", and "side" do not limit the respective panels to such orientation, but merely serve to distinguish these panels from one another. Any reference to hinged connection should not be construed as necessarily referring to a single fold line only: indeed it is envisaged that hinged connection can be formed from one or more of one of the following, a score line, a frangible line or a fold line, without departing from the scope of invention. The present invention and its preferred embodiment relates to a tray which is shaped to provide satisfactory rigidity to hold items such as meat or fish securely but with a degree of flexibility. The shape of the blank minimises the amount of paperboard required for the carton. The items can be applied to the carrier by hand or automatic machinery. It is anticipated the invention can be applied to a variety of carton or tray types and not limited to those of the flat tubular sort, for example the flat tubular structure could be replaced by a structure with longer sides and end panels to receive larger cuts of meat. Furthermore, the double skinned zones can be formed on the inner panels of the carton, without departing from the scope of invention.

What is claimed is:

1. A tray formed from foldable sheet material, the tray including a base having a first surface for defining at least a portion of an interior surface of the tray, opposed side and end walls hingedly connected to the base, and wherein means are provided to give fluid communication between said first surface of the base and a void so that fluid present in the tray can drain into the void, characterised in that the void is formed by a double skinned zone adjacent at least a portion of the intersection between the base and at least one of the side and/or end walls, the double skinned zone being provided by folded outer panels of the side and/or end walls.

2. A tray according to claim 1 wherein said fluid communication means comprises a plurality of perforations formed in the base.

3. A tray according to claim 2 wherein said plurality of perforations are distributed along at least one edge of the base.

4. A tray according to claim 1 wherein the void includes absorbing means to absorb said liquid.

5. A tray according to claim 4 wherein the foldable sheet of material is paperboard, and wherein the absorbing means is provided by at least a portion of the paperboard forming the double skinned zone.

6. A tray according to claim 4 wherein the absorbing means is provided by a layer of liquid absorbing material placed in the void.

7. A tray according to claim 1 wherein said first surface of the base is impermeable.

8. A tray according to claim 7 wherein said first surface is coated with an impermeable layer.

9. A tray according to claim 8 wherein the impermeable layer is formed by a co-polymer.

10. A blank for forming a tray comprising a base panel, side and end panels hingably connected to the base panel, and securing means for securing together adjacent ones of said side and end panels to form a corner of the tray when the blank is erected, wherein means are provided to give fluid communications between the internal surface of the base when erected to form a carton and a void so that fluid present in the erected tray can drain into the void, characterised in that a further blank portion is provided capable of being brought into a position adjacent the intersection between the base and at least one of the side and/or end panels so as to form a double skin thereby to form the void.

11. A blank according to claim 10 wherein the further portion is hingedly connected to said at least one side and/or end panels along an edge of said panel remote from said base panel.

12. A blank according to claim 10 wherein said fluid communication means comprises a plurality of perforations distributed along at least one edge of said base panel.

* * * * *